US005285211A

United States Patent [19]

Herper et al.

[11] Patent Number: 5,285,211

[45] Date of Patent: Feb. 8, 1994

[54] COAXIAL COLLINEAR ELEMENT ARRAY ANTENNA

[75] Inventors: John C. Herper, Glen Cove; Anthony M. Bucceri, Jr., Larchmont; John E. Arthur, III, Island Park, all of N.Y.

[73] Assignee: Unisys Corporation, Blue Bell, Pa.

[21] Appl. No.: 939,260

[22] Filed: Sep. 2, 1992

[51] Int. Cl.[5] ..... H01Q 1/16

[52] U.S. Cl. ..... 343/791; 343/792; 343/878; 343/905

[58] Field of Search ..... 343/790–792, 343/878, 906, 905; 174/75 C, 88 C, 99 R, 138 A, 138 R; H01Q 1/14, 1/16, 1/50, 9/04, 9/16

[56] References Cited

U.S. PATENT DOCUMENTS 2,115,761 5/1938 Blumlein ..... 343/790

2,483,240 9/1949 Shanklin ..... 343/791

*Primary Examiner*—Michael C. Wimer

*Attorney, Agent, or Firm*—Seymour Levine; Mark T. Starr; Stanton Weinstein

[57] ABSTRACT

An array of collinear coaxial lines utilizes standard size brass tubing with brass rods inserted therein to establish each half-wavelength coaxial section. A coupler positioned between each half-wavelength section has an outer conductor supports and through passages for the inner conductor. Inner conductors of the transmission line elements are soldered to the outer conductors of the respective adjacent transmission line elements so that all elements are excited with the same phase and polarity. Air dielectric between the inner and outer conductors provides a transmission line wavelength equal to that of free space so that the length of each element in the array is a free space half-wavelength long, thereby providing an antenna gain greater than that achievable with transmission lines having solid dielectric supporting the inner conductor.

6 Claims, 2 Drawing Sheets

COAXIAL COLLINEAR ELEMENT ARRAY ANTENNA

BACKGROUND OF THE INVENTION

1. Field of the Invention

The invention pertains to the field array antennas and more particularly to an array of coaxial elements arranged in a linear alignment.

2. Description of the Prior Art

A linear array of coaxial elements of the prior art comprises a plurality of coaxial cables, each having a solid dielectric between the inner and outer conductors, wherein the inner conductor of one cable is connected to the outer conductor of the succeeding cable. The wavelength of a wave propagating within a cable section is a function of the dielectric constant of the dielectric material and is given by $\lambda/\sqrt{\epsilon}$, where $\lambda$ is the free space wavelength and $\epsilon$ is the dielectric constant of dielectric material. Each section is one half a cable wavelength long. Since the dielectric on the outside of the cable is air, which has a dielectric constant that is less than that of the solid dielectric, the wavelength of a propagating wave in free space exceeds the cable wavelength. Consequently, each section is less than one half of a free space wavelength, the overall length being $\lambda/2\sqrt{\epsilon}$.

Performance of the prior art coaxial collinear array is degraded by the dielectric loading in three ways: first, the current distribution over the element sections is not uniform; second, the dielectric is lossy and contributes to antenna inefficiency; and third, the length per section is foreshortened, thereby adversely effecting the antenna gain. Further, the element sections are constructed of semi-rigid coaxial cable which must be cut to close tolerances, stripped at the ends, and the delicate operation of soldering the inner conductor of one section to the outer conductor of the next section performed. The soldering operation is especially difficult when the dielectric material has a low melting temperature such as polyethelene foam which is commonly used for its low loss characteristics.

SUMMARY OF THE INVENTION

In accordance with the present invention a coaxial collinear antenna uses standard size brass tubing with brass rods inserted therein to establish each half-wave section of a coaxial collinear array antenna. The rod is supported in the tube by a novel coupler, which may be made of TEFLON, ABS plastic, or any other suitable dielectric material. This coupler eliminates the dielectric material for supporting the rod in the tube, thereby providing coaxial sections with an air dielectric. Consequently, the propagation velocity in the coaxial sections is substantially equal to that of free space, being only slightly affected by the TEFLON couplers. Each coupler is arranged to support two rods in a manner which positions each rod adjacent to the tube associated with the other rod for easy soldering and provides uniform spacing, throughout the antenna, between section rods. The construction of the coupler isolates the solder joints from potentially destructive forces by transferring the loads to the tubes. The assembled coaxial collinear array antenna is inserted into an outer plastic tube which provides rigidity and protection from the environment.

These and other features of the invention will become more apparent from the detailed description to follow with reference to the accompanying drawings.

DESCRIPTION OF THE PREFERRED EMBODIMENTS

Figure 1:
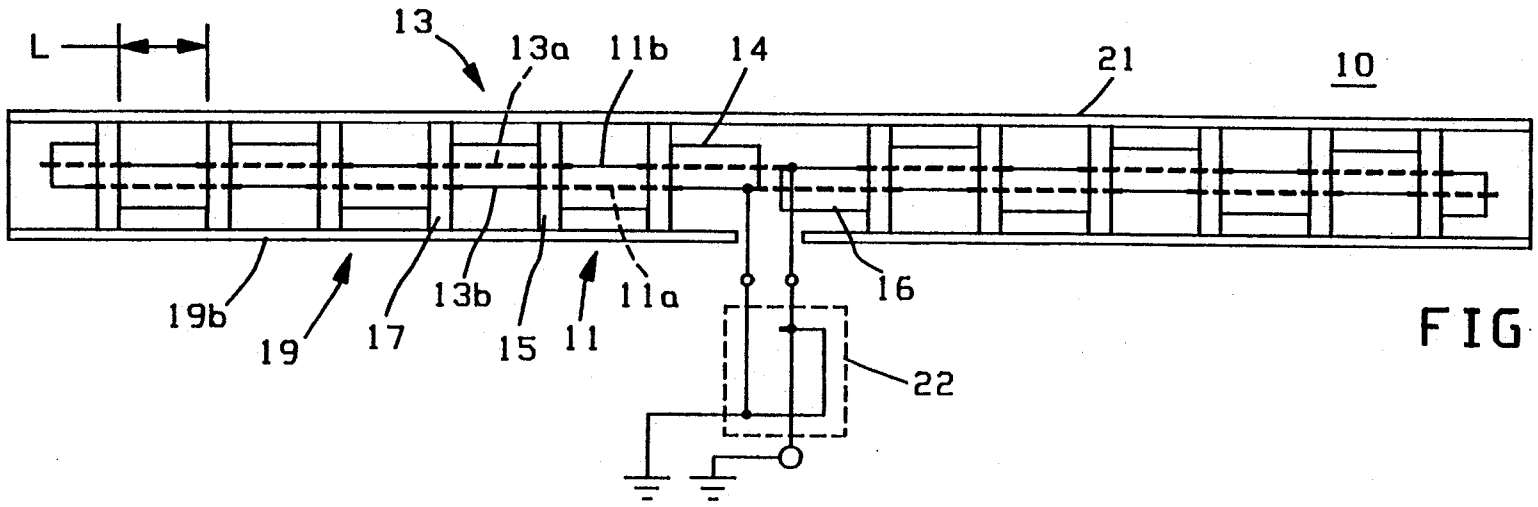
FIG. 1 is a representation of a coaxial collinear array antenna constructed in accordance with the principles of the invention.

Refer now to FIG. 1. A coaxial collinear array antenna 10 in accordance with the invention includes a plurality of coaxial elements, of which elements 11 and 13 are representative. The array is formed by coupling the coaxial elements through dielectric couplers which support the elements. For example, the inner conductor 11*a* of element 11 extends through an element coupler 15, to be described, and is soldered to the outer conductor 13*b* of element 13. The outer conductor 11*b* of element 11 is soldered to the inner conductor of the preceding element in like manner. Similarly, the inner conductor 13*a* of element 13 extends through an adjacent coupler 17 and is soldered to the outer conductor 19*b* of the next element 19 of the array. Each coaxial element has an air dielectric between the inner and outer conductors. Rigidity is added to the array by inserting the assembled elements and couplers into a plastic pipe 21, which also acts as a radome to provide protection from the elements.

As shown in FIG. 1, a signal is fed to a balun 22 wherefrom signals of equal amplitude and opposite phase are coupled to the two outer conductors of the central coaxial lines 14, 16. The length L of each coaxial element in the array is equal to one-half wavelength in the coaxial line. Since the dielectric between the inner and outer conductors is air, this wavelength is equal to the free space wavelength. This length and the phase transposition at each coupler causes each coaxial line element to be excited with the same polarity and phase. Thus, the element to element current on the outer conductors is in phase along the entire length of the array, thereby providing a radiator having substantially the properties of an array composed of N collinear half wave dipoles, N being the number of elements in the array, fed in phase.

Figure 2:
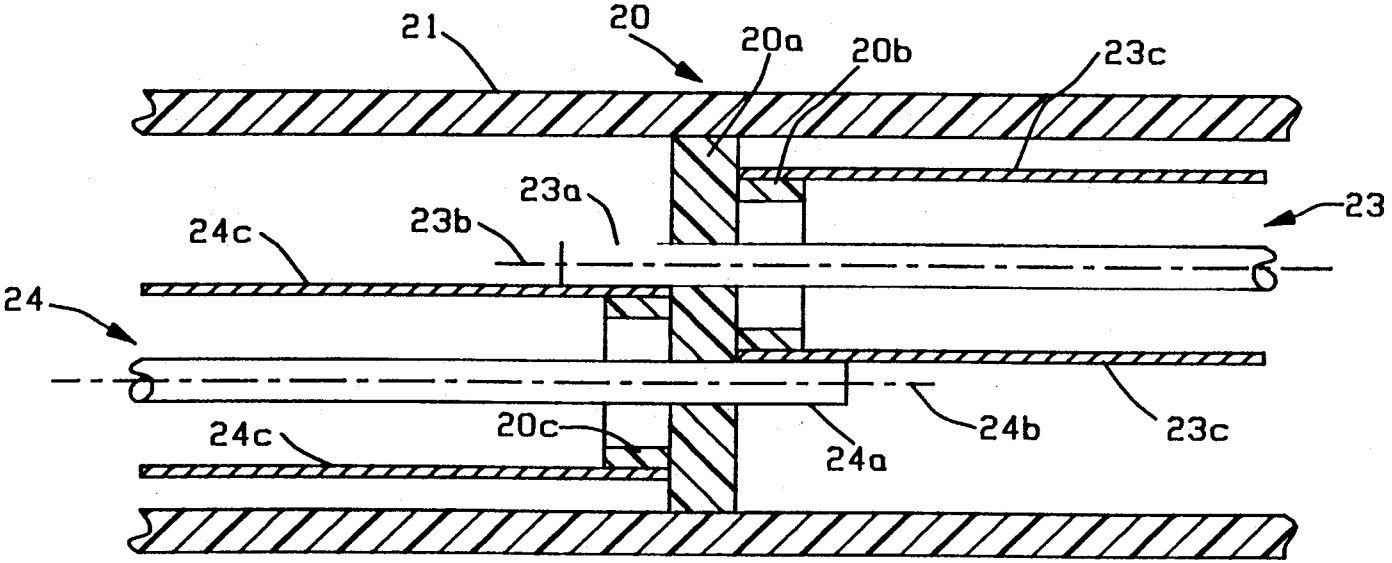
FIG. 2 is a cross sectional view of a coupling region in the antenna of FIG. 1.
Figure 3B:
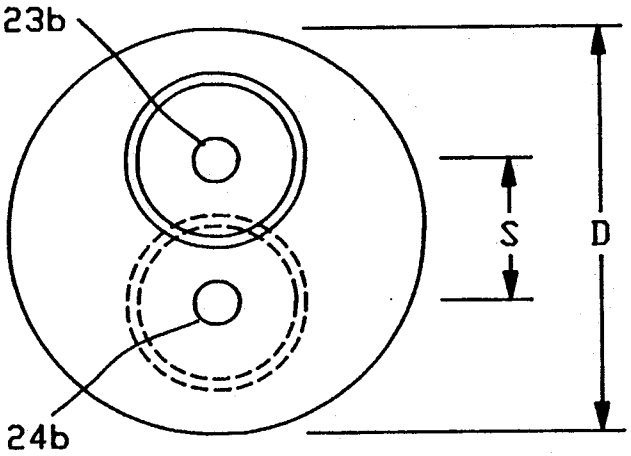
FIGS. 3A and 3B are plane and side views, respectively, of an element coupler utilized in the array of FIG. 1.
Figure 3A:
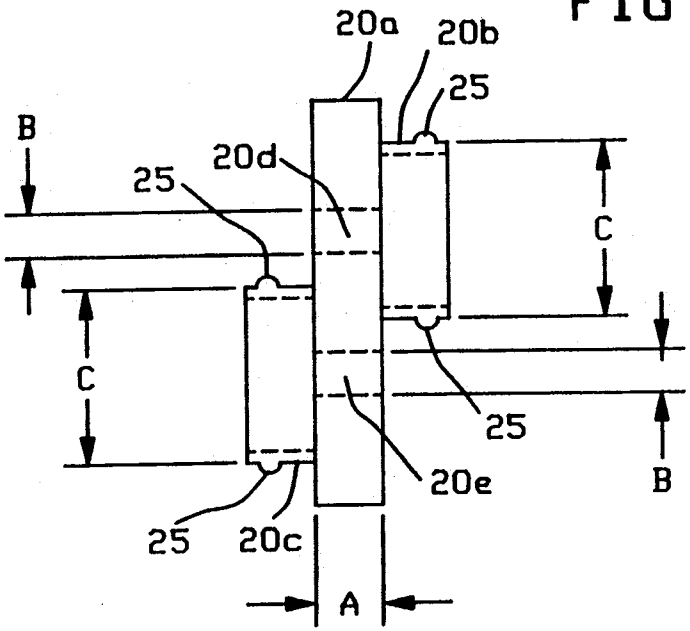

A dielectric coupler exemplifying the supporting structure of the inner and outer conductors is illustrated in FIGS. 2, 3A, and 3B, wherein similar elements bear the same reference numerals. The coupler 20 may be constructed of a dielectric material such as TEFLON, ABS plastic, or other suitable dielectric material to provide a central disk 20*a* having a thickness A, which provides structural integrity—the thickness being empirically chosen to maximize radiation efficiency—, a diameter D, equal to the inner diameter of the plastic pipe 21, and two circular through passages 20*d* and 20*e* with respective offset center lines 23*b* and 24*b* with spacing S therebetween. The diameter B of the passages are chosen to permit rods 23*a* and 24*a*, which form the previously mentioned inner conductors, to slide respectively therethrough and be in substantial contact with the central disk 20*a*. Appended to the central disk 20*a* are offset tube supports 20*b* and 20*c*, respectively concentric with the passages 20*d* and 20*e*, each having an outer diameter C. The outer diameter C being substantially equal to the inner diameter of the tubes 23*c* and 24*c*. It is evident that the rod 23*a* and the tube 23*c* form a coaxial line 23 and that the rod 24*a* and the tube 24*c* form a coaxial line 24, the rods 23*a* and 24*a* providing the inner conductors and the tubes 23*c* and 24*c* providing the outer conductors. The offset of the tube supports 20*b* and 20*c*, provided by the spacing S between the center lines 23*b* and 24*b*, is chosen so that the outer diameters of the outer conductors 23*c* and 24*c* respectively contact the inner conductors 24*a* and 23*a*, thereby allowing the inner conductors 23*a* and 23*b* to be easily soldered to the outer conductors 24*c* and 23*c*. This coupler construction not only allows the inner conductors to be easily soldered to the outer conductors, it enhances the electrical performance of the antenna by maintaining the inner and outer conductor concentricity of the respective coaxial lines and by providing uniform inter element gap spacing throughout the antenna. It should be noted that the diameter and thickness of the central section is chosen so that the weight of the coaxial lines is transferred to and supported by the plastic pipe.

Figure 4:
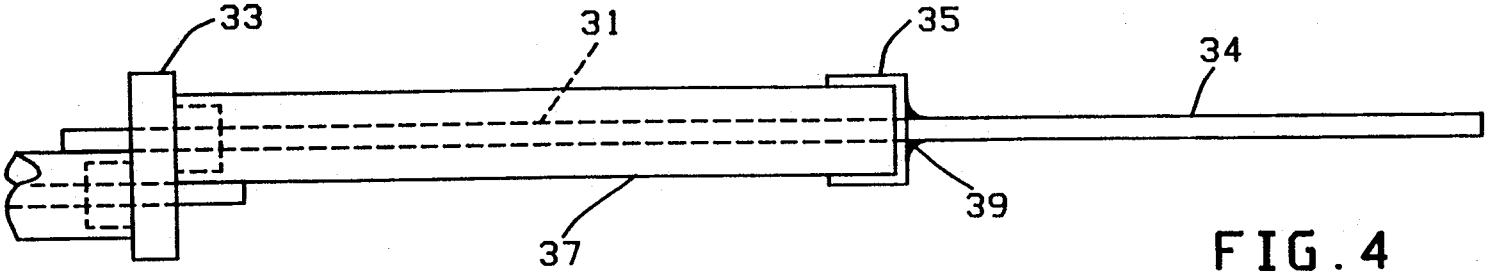
FIG. 4 is a representation of an end element for the array of FIG. 1.

Those skilled in the art should recognize that a voltage minimum and a current maximum exists at the center of each element, while a voltage maximum and a current minimum is at the end of each element. Such a condition must be maintained at the end sections of the array. This pattern may be realized with an end section configured as shown in FIG. 4. The inner conductor 31 of the end section extends a quarter wavelength from the last coupler 33 to a copper cap 35 and therethrough, to provide an extended inner conductor 34, for an additional quarter wavelength. The inner conductor 31 and the outer conductor 37 are soldered to the copper cap 35, as indicated at 39, to establish a short circuit at the plane of the soldered joint, thereby causing a zero voltage and maximum current thereat. A quarter wavelength from the point of maximum current a substantially open circuit exists at the end of the extended inner conductor 34, the current is substantially zero thereat and the voltage is at a maximum. Thus, the current variation between the shorting plane and the end of the extended inner conductor is monotonic and the pattern of a minimum voltage and a maximum current at the center of the end element and maximum voltage and minimum current at the tip of the end element is established.

While the invention has been described in its preferred embodiments, it is to be understood that the words which have been used are words of description rather than limitation and that changes may be made within the purview of the appended claims without departing from the true scope and spirit of the invention in its broader aspects.

We claim:

1. An antenna comprising:

a plurality of coaxial transmission lines each having an inner conductor having an outer diameter and an outer conductor having an inner diameter, said inner conductor of each coaxial transmission line being soldered to said outer conductor of a next adjacent coaxial transmission line;

coupler means positioned between each coaxial transmission line and said next adjacent coaxial transmission line for supporting said inner and outer conductors of said each coaxial transmission line and said next adjacent transmission line in a manner that maintains concentricity of inner and outer conductors of adjacent transmission lines;

said coupler means including a dielectric coupler constructed of dielectric material comprising a central disk having a predetermined diameter and offset outer conductor supports positioned on opposite sides of said central disk, said outer conductor supports having outer diameters substantially equal to said inner diameter of each outer conductor and concentric with an inner conductor through-passage in said central disk having a diameter substantially equal to said outer diameter of each inner conductor, said offset of said outer conductor supports is established so that said inner conductor of a coaxial transmission line passed through said inner conductor through-passage is in substantial contact with said outer conductor of said next adjacent coaxial transmission line.

2. The antenna of claim 1 wherein each coaxial transmission line of said plurality of coaxial transmission lines has an air dielectric between said inner and outer conductors.

3. The antenna of claim 1 wherein said coupler means includes a plurality of couplers, each coupler of said plurality of couplers being said dielectric coupler, each coupler of said plurality of couplers positioned between adjacent coaxial transmission lines.

4. The antenna of claim 1 further including a plastic pipe having an inner diameter substantially equal to said predetermined diameter of said central disk positioned to contain said plurality of coaxial transmission lines and said coupler means therewithin.

5. The antenna of claim 4 wherein each coaxial transmission line of said plurality of coaxial transmission lines has an air dielectric between said inner and outer conductors.

6. The antenna of claim 5 wherein said coupler means includes a plurality of couplers, each coupler of said plurality of couplers being said dielectric coupler, each coupler of said plurality of couplers positioned between adjacent coaxial transmission lines.

* * * * *